US005427251A

United States Patent [19]

Landmann et al.

[11] Patent Number: 5,427,251

[45] Date of Patent: Jun. 27, 1995

[54] TIPPING GRID FOR FLOATING DREDGES

[75] Inventors: Peter Landmann, Weinheim; Werner Knecht, Stuttgart, both of Germany

[73] Assignee: PS Foerder- und Lagertechnik, Mannheim, Germany

[21] Appl. No.: 162,394

[22] Filed: Dec. 6, 1993

[30] Foreign Application Priority Data

Dec. 10, 1992 [DE] Germany ..... 9216788 U

[51] Int. Cl.[6] ..... B07B 1/52

[52] U.S. Cl. ..... 209/388; 198/498

[58] Field of Search ..... 209/379, 385, 386, 387, 209/388; 198/498, 494

[56] References Cited

U.S. PATENT DOCUMENTS 784,584 3/1905 Myers ..... 209/387

1,263,829 4/1918 Wintersgill ..... 209/387

4,116,326 9/1978 Tuman ..... 209/387 X 4,287,064 9/1981 Ando et al. ..... 209/388 X 4,731,180 3/1988 Huff ..... 209/387 X 4,792,394 12/1988 Rudzinski ..... 209/385 X

*Primary Examiner*—D. Glenn Dayoan

*Attorney, Agent, or Firm*—Foley & Lardner

[57] ABSTRACT

A tipping grid assembly includes a frame in which a tipping grid is supported and a scraper disposed above and reciprocatingly movable with respect to the tipping grid. The scraper includes a bridge having top and bottom chords, and teeth on the bottom chord over the tipping grid. A pair of running rails are attached to the frame to support a pair of posts which in turn support the top chord of the bridge. A pair of chains pull the bridge over the tipping grid to remove clogged material.

3 Claims, 1 Drawing Sheet

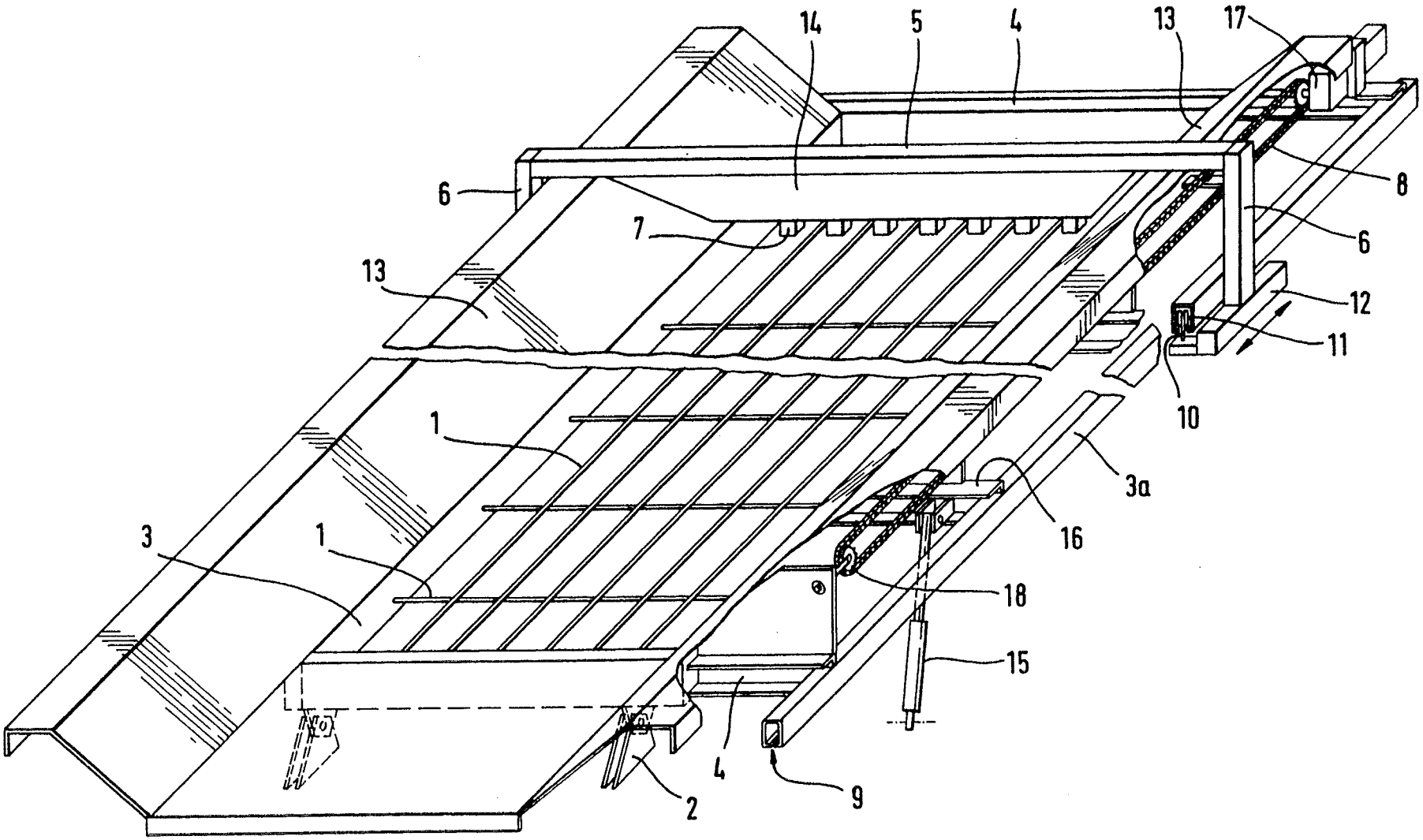
17
8
6
12
11
13
10
3a
16
4
18
15
5
9
14
4
7
2
6
1
13
1
3

TIPPING GRID FOR FLOATING DREDGES

BACKGROUND OF THE INVENTION

The present invention relates generally to a tipping grid for use on floating dredges, and more particularly, to a tipping grid assembly which includes a mechanism for cleaning material out of the grid.

In dredging operations, material picked up by the dredging shovels is deposited on a tipping grid and by means of the latter is separated from oversize particles, which are discharged through the inclination of the grid.

It is a frequent problem with tipping grids of this kind, however, that soiling and clogging of the grid will occur, particularly when the earth is loamy, so that gravel cannot pass through the grid as desired. Consequently, such grids must be repeatedly cleaned by the operating crew.

SUMMARY OF THE INVENTION

Accordingly, it is an object of the present invention to provide a tipping grid whose inclination is adjustable and which can be cleaned mechanically.

It is another object of the present invention to provide a tipping grid assembly with a mechanism for cleaning the grid in a safe manner and without exposure of the mechanical elements to soiling.

A further object of the invention is to provide a tipping grid assembly with a mechanism for cleaning the grid which is also able to carry away any large amounts of loam which are deposited during cleaning of the grid.

In accomplishing these and other objects, there has been provided a tipping grid assembly which includes a frame for supporting a tipping grid, and a scraper disposed above and reciprocatingly movable with respect to the tipping grid. The scraper includes a bridge having top and bottom chords, with teeth located on the bottom chord over the tipping grid. A pair of running rails are attached to the frame to support a pair of posts which in turn support the top chord of the bridge. A pair of chains pull the bridge over the tipping grid to rid the grid of clogged material and to scrape away any loam which is deposited during cleaning.

According to another aspect of the invention, there has been provided a method for cleaning a tipping grid comprising the steps of (a) providing a tipping grid assembly which includes a frame and a tipping grid supported by the frame; a scraper disposed above and reciprocatingly movable with respect to the tipping grid, and including a bridge having top and bottom chords with teeth disposed on the bottom chord over the tipping grid; a pair of running rails attached to the frame; a pair of posts movingly attached to the running rails and supporting the top chord; and a pair of chains for pulling the bridge; and (b) pulling the bridge over the tipping grid with the chains.

Other objects, features and advantages of the present invention will become apparent to those skilled in the art when the preferred embodiments of the invention are more fully described below with reference to the drawing.

BRIEF DESCRIPTION OF THE DRAWINGS

The present invention is explained more fully with reference to the accompanying FIGURE in which a tipping grid assembly according to the present invention is shown in partial section.

DETAILED DESCRIPTION OF THE PREFERRED EMBODIMENTS

Referring now to the FIGURE, a tipping grid 1 is shown arranged on a frame having a pair of longitudinal members 3 and a pair of transverse members 4. The grid 1, together with frame 3, 4, is adjustable with respect to an inclination relative to horizontal by means of tipping bearings 2 and hydraulic rams 15, which can act, for example, on central chords 16.

In one embodiment, a geared motor 17 is fastened at one end and to one side of the frame. Disposed at an opposite end of the frame is a return roller 18 over which a closed chain 8, driven by the motor 17, is guided. A running rail 3*a* is disposed on a transverse frame member 4 so as to run along both longitudinal sides of the frame, and has at the bottom a longitudinally extending slot 9 through which arms 10 extend. These arms 10 are carried in the rails 3*a* by running rollers 11, which in turn are joined to a trolley carrier 12, on the center of which rest the posts 6 which together with the top chord 5 form a bridge.

This bridge is engaged over inclined side metal plates 13, which guide towards the center of the grid 1 any material which falls down, thereby protecting the chain 8 and the motor 17 from soiling.

A bottom chord (pusher) 14 in the form of a trapezoidal box extends downwards from the top chord 5 and in turn carries the teeth 7 which are engaged in the grid 1 and comb the latter when required for cleaning purposes. It is noted that the longitudinally extending arms of the grid project above the transversely extending arms, thereby facilitating such cleaning.

In operation, the teeth 7 which extend into the grid 1 or into the longitudinal grooves of the latter, are moved over the grid 1 as required, preferably with the grid 1 in a tipped position. Since this may give rise to great forces, the structure comprising the frame 3, 4 and the bridge must be of an appropriately sturdy construction.

During this movement, the bridge can be guided in a particularly safe manner and without being greatly exposed to soiling if the running rails 3*a* are each provided with a slot 9 which extends longitudinally along the bottom of a running rail 3*a*. Rollers 11 are joined to the arms 10 which extend through slot 9 and carry trolleys 12 of the bridge. The rollers 11 are embraced all-around by rails 3*a* (i.e. disposed within the rail), which in turn protects the rollers 11 against the obviously considerable soiling which could occur during dredging.

In order to avoid tilting, the bridge may be provided with a chain drive 8, 17 and 18, on both sides of the frame. For reasons of cost, however, preference is given to a drive on one side which drives a similar chain drive on the other side by means of a shaft (not shown). A plurality of rollers disposed crosswise relative to one another are mounted in each trolley carrier 12, so that guidance along and transversely to each running rail 3*a* is achieved, thus giving particular protection against tilting.

As mentioned previously, the chain 8 and its drive 17 may advantageously be disposed under lateral metal plates 13 which are inclined towards the grid 1 in order to guide towards the center of the grid 1 any material which falls down at the same time, thereby protecting the chain 8 and the drive 17.

Finally, it is proposed to dispose a metal plate as a pusher (bottom chord 14) between the teeth 7 and the top chord 5 of the bridge, in order to carry away quickly any large amounts of loam which arrive suddenly during cleaning.

A tipping grid and method for cleaning a tipping grid are thus provided for use on floating dredges, wherein according to the invention the tipping grid is embraced by a frame and a scraper, consisting of a bridge having teeth disposed on a bottom chord, can be moved reciprocatingly over the tipping grid, while a top chord of the bridge rests on a trolley capable of running along a running rail on the side of the frame. The bridge is pulled over the tipping grid by a geared motor with the aid of a chain running continuously over a chain wheel attached to the motor and a return roller.

While the invention has been described with reference to particular embodiments thereof, those skilled in the art will appreciate that certain modifications and additions can be made without departing from the field of the invention which should only be limited in scope by the appended claims.

What is claimed is:

1. A tipping grid assembly with adjustable inclination for arrangement above a hopper on floating dredges, comprising:

a) a frame;

b) a tipping grid supported by said frame;

c) a scraper, disposed above and reciprocatingly movable with respect to said tipping grid, said scraper including a bridge having top and bottom chords, and teeth disposed on said bottom chord over said tipping grid;

d) a running rail attached to said frame;

e) a post movingly attached to said running rail and supporting said top chord; and f) a chain for pulling said bridge over said tipping grid;

wherein said running rail is supported along a longitudinal side of said frame and provided with a longitudinal slot defined in a bottom surface of said running rail, said tipping grid assembly further comprising rollers disposed within said running rail, arms which attach to said rollers through said longitudinal slot, and a trolley carrier which supports said arms and said post.

2. A tipping grip assembly with adjustable inclination for arrangement above a hopper on floating dredges, comprising:

a) a frame;

b) a tipping grid supported by said frame;

c) a scraper, disposed above and reciprocatingly movable with respect to said tipping grid, said scraper including a bridge having top and bottom chords, and teeth disposed on said bottom chord over said tipping grid;

d) a running rail attached to said frame;

e) a post movingly attached to said running rail and supporting said top chord;

f) a chain for pulling said bridge over said tipping grid; and g) inclined metal plates disposed on opposite sides of said tipping grid, wherein said chain is arranged under said inclined metal plates.

3. A tipping grid assembly with adjustable inclination for arrangement above a hopper on floating dredges, comprising:

a) a frame;

b) a tipping grid supported by said frame;

c) a scraper, disposed above and reciprocatingly movable with respect to said tipping grid, said scraper including a bridge having top and bottom chords, and teeth disposed on said bottom chord over said tipping grid;

d) a running rail attached to said frame;

e) a post movingly attached to said running rail and supporting said top chord; and f) a chain for pulling said bridge over said tipping grid;

wherein said bottom chord is situated between said top chord of the bridge and said teeth to serve as a pusher.

* * * * *